US008012576B2

(12) United States Patent
Lee et al.

(10) Patent No.: US 8,012,576 B2
(45) Date of Patent: Sep. 6, 2011

(54) ROOF COVERINGS HAVING IMPROVED TEAR STRENGTH

(75) Inventors: Jerry H C Lee, Columbus, OH (US); Gregory S. Helwig, Granville, OH (US); David R. Jones, IV, Tampa, FL (US); David C. Trumbore, LaGrange, IL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 10/826,207

(22) Filed: Apr. 16, 2004

(65) Prior Publication Data

US 2005/0233663 A1 Oct. 20, 2005

(51) Int. Cl.
*B32B 27/04* (2006.01)
*B32B 19/00* (2006.01)

(52) U.S. Cl. ..... 428/299.4; 428/357; 428/375; 428/392

(58) Field of Classification Search ..... 442/180; 428/143–155, 299.4, 357, 375, 392
See application file for complete search history.

(56) References Cited

U.S. PATENT DOCUMENTS

| | | | | |
|---|---|---|---|---|
| 3,992,340 | A | 11/1976 | Bonitz | |
| 4,079,158 | A * | 3/1978 | Kennepohl et al. | 428/143 |
| 4,135,022 | A | 1/1979 | Kennepohl et al. | |
| 4,210,459 | A * | 7/1980 | Williams et al. | 106/489 |
| 4,265,563 | A * | 5/1981 | Marzocchi et al. | 404/75 |
| 4,332,704 | A | 6/1982 | Marzocchi et al. | |
| 4,339,277 | A * | 7/1982 | Schult | 106/275 |
| 4,375,988 | A * | 3/1983 | Mueller et al. | 106/275 |
| 4,626,289 | A | 12/1986 | Hsu | |
| 5,371,121 | A | 12/1994 | Bellomy et al. | |
| 6,228,785 | B1 * | 5/2001 | Miller et al. | 442/148 |
| 2004/0265586 | A1 * | 12/2004 | Gonthier et al. | 428/375 |

FOREIGN PATENT DOCUMENTS

| | | | |
|---|---|---|---|
| GB | 1568449 | | 5/1980 |
| WO | WO 00/44975 | * | 8/2000 |
| WO | WO 03000611 A1 | * | 1/2003 |

* cited by examiner

*Primary Examiner* — D. Lawrence Tarazano
*Assistant Examiner* — Matthew D Matzek
(74) *Attorney, Agent, or Firm* — MacMillan, Sobanski & Todd, LLC

(57) ABSTRACT

A roof covering includes a roofing mat formed from fibers of a fiber material. The fibers are coated with a sizing. The roof covering also includes a coating material that coats the mat. The coating material is based on an organic material. The sizing includes a sulfur-containing material that bonds to the fiber material. The sulfur-containing material has sulfur groups that form cross-links with the organic material. In another embodiment, the coating material contains sulfur added to the organic material. The sizing includes a bonding material that bonds to the fiber material and that bonds to the sulfur. The sulfur forms cross-links with the organic material.

36 Claims, No Drawings

ROOF COVERINGS HAVING IMPROVED TEAR STRENGTH

TECHNICAL FIELD AND INDUSTRIAL APPLICABILITY OF THE INVENTION

The present invention is related generally to roof coverings such as roofing shingles, and more particularly to roof coverings having improved tear strength.

BACKGROUND OF THE INVENTION

Roof coverings are frequently subjected to stresses that can cause tearing, for example, during the manufacturing process, from rough handling when they are applied on a roof, and from the effects of people walking on the roof after they have been applied. Therefore, it would be desirable to produce roof coverings having improved tear strength to withstand tearing under these and other stressful conditions.

U.S. Pat. No. 4,079,158 to Kennepohl et al., issued Mar. 14, 1978, discloses asphalt roofing shingles in which sulfur is added to the asphalt in an amount between 10% and 55% by weight. The addition of the sulfur to the asphalt is said to provide the shingles with greater fire resistance. There is no suggestion to use sulfur to improve the tear strength of the shingles.

SUMMARY OF THE INVENTION

This invention relates to a roof covering including a roofing mat formed from fibers of a fiber material. The fibers are coated with a sizing. The roof covering also includes a coating material that coats the mat. The coating material is based on an organic material. The sizing includes a sulfur-containing material that bonds to the fiber material. The sulfur-containing material has sulfur groups that form cross-links with the organic material.

The invention also relates to a roof covering including a roofing mat formed from fibers of a fiber material. The fibers are coated with a sizing. The roof covering also includes a coating material that coats the mat. The coating material is based on an organic material. The coating material contains sulfur added to the organic material. The sizing includes a bonding material that bonds to the fiber material and that bonds to the sulfur. The sulfur forms cross-links with the organic material.

DETAILED DESCRIPTION AND PREFERRED EMBODIMENTS OF THE INVENTION

The roof covering of the invention can be any type that includes a fibrous roofing mat and an organic-based coating material on the mat, such as a three-tab roofing shingle, a laminated roofing shingle, roll roofing, or built-up roofing.

The roofing mat is formed from fibers of a fiber material. By "fiber material" is meant any type of fiberizable or fibrous material suitable for producing a roofing mat. Any type of suitable fiberizable material can be used; for example, the fibers can be mineral fibers, polymer fibers, carbon fibers, metal fibers, or mixtures thereof. Suitable mineral fibers for producing the mat include fibers of a heat-softenable mineral material, such as glass, ceramic, rock, slag, or basalt. The fibrous material for producing the roofing mat can be any suitable natural or synthetic fiber. For example, some natural fibers that can be used include, without limitation, jute, sisal, hemp, kenaf, etc.

Any suitable process can be used to produce the fibers from the fiberizable material. Production of glass fibers usually involves attenuation of the fibers from molten streams of fiberizable glass from a bushing or spinner connected to a furnace containing molten glass. The fibers are attenuated by conventional means such as winders or high pressure air jets. Processes for producing fibers from other types of fiberizable material are well known.

The fibers are coated with a sizing to improve the processing characteristics of the fibers, and to improve the performance of the fibers in the end product. Sizing formulations for fibers are well known. They typically comprise an aqueous solution containing a lubricant, a film-forming polymer, a coupling agent, and sometimes processing aids. The sizing can be applied by any suitable method/apparatus. Typically the sizing is applied to the fibers shortly after they are attenuated as the molten streams of glass. The sized fibers are wet and chopped to a desired length.

A nonwoven or woven roofing mat is formed from the fibers by any suitable method. Typically, the mat is a nonwoven mat produced by a wet-laid process. In this process, a water slurry is provided into which the fibers are dispersed. The water slurry may contain surfactants, viscosity modifiers, defoaming agents, or other chemical agents. Fibers are then introduced into the slurry and agitated such that the fibers become dispersed. The slurry containing the fibers is then deposited onto a moving screen, and a substantial portion of the water is removed to form a web. A binder is then applied, and the resulting mat is dried to remove the remaining water and to cure the binder. The resulting nonwoven mat consists of an assembly of substantially dispersed individual fibers. A nonwoven mat can also be produced by a dry-laid process. In this process, fibers are chopped and air blown onto a conveyor, and a binder is then applied to form the mat. Any suitable binder can be used, such as urea formaldehyde, acrylic resin, or styrene-butadiene latex.

The roofing mat is passed through a coater where a coating material is applied to the mat. In a typical process, the mat is submerged in a supply of hot, molten coating material to completely cover the mat with the tacky coating material. However, the coating material can also be sprayed on, rolled on, or applied to the mat by any other suitable means. The coating material is based on an organic material such as a bituminous material and/or a polymeric material (e.g., a polymer, a recycled polymer stream or ground tire rubber). Any type of bituminous material suitable for coating roof coverings can be used, such as asphalt, tar, pitch, or a mixture thereof. The coating material can also include various additives and/or modifiers, such as inorganic fillers or mineral stabilizers. In a typical asphalt roofing shingle, the coating material includes asphalt and a filler of finely ground inorganic particulate matter, such as ground limestone, in an amount within a range of from about 40% to about 80% by weight of the coating material.

In the manufacture of roofing shingles and roll roofing, the mat coated with hot coating material is passed beneath one or more granule applicators that discharge protective roofing granules onto the top surface. A backdust is usually applied to the back surface. Next, the coated mat is passed through a cooling section in which the coating material is cooled. After the cooling process, the coated mat is cut into the desired shape of the roof covering.

It has now been discovered that the tear strength of the roof coverings can be significantly improved by the use of sulfur vulcanizing chemistry. In a first embodiment of the invention, this improvement is achieved by a modification of the sizing. A sulfur-containing material is added to the sizing that bonds to the fiber material (e.g., glass) of the roofing mat. The material can bond to the fiber material in any suitable manner. For example, the material can have functional groups that bond to the fiber material. This method of bonding is usually effective for silica-based fibers and metal fibers. Different functional groups are used for bonding depending on the particular fiber material. Alternatively, the material can be bonded to the fiber material by a grafting technique. This method of bonding is usually effective for polymer fibers and natural fibers. The bonding allows the material to anchor to the fiber material.

The material also has sulfur groups that form cross-links with the organic material (e.g., asphalt) of the coating material. This allows the sulfur to react with residual double bonds in the organic material when the hot coating material is coated on the roofing mat. In turn, this enhances the interfacial bonding between the fiber material and the organic material and improves the tear strength of the roof covering.

Any suitable sulfur-containing material that bonds to the fiber material can be used in the invention. Some nonlimiting examples of functional groups that can bind to silica-based fibers (e.g., glass) are silane groups. In a preferred embodiment, the material is a sulfide silane, for example Silquest® RC-2 polysulfide silane from GE Silicones-OSi Specialties, Wilton, Conn. Other suitable sulfide silanes include Silquest® A-189, Silquest® A-1289 and Silquest® A-1589, all from GE Silicones-OSi Specialties.

Grafting is a deposition technique whereby materials can be bonded to polymers. Grafting methods are well known.

The material can be added to the sizing in any amount suitable for achieving the improved tear strength. Preferably, the amount of the material added to the sizing is from about 1% to about 10% by weight of the solids in the sizing, more preferably from about 1% to about 5%, and optimally about 3.5%. The remainder of the sizing formulation can include materials conventionally used in sizings.

The invention improves the tear strength of all types of roof coverings. When the roof covering is a roofing shingle, typically the tear strength of the roofing shingle is increased by at least about 5% compared to the same roofing shingle without the compound in the sizing. Preferably, the tear strength is increased by at least about 10%, and more preferably at least about 15%. Tear strength can be measured by any suitable method; one method is the measurement of cross-machine (CD) tear, in which tear strength is measured in the cross-machine direction of the roof covering using procedures described in ASTM D 1922. An Elmendorf Tear Strength Tester or other suitable apparatus can be used for this measurement.

The invention can improve the tear strength without sacrificing mat tensile and dispersion properties. Preferably, the tensile strength of the roofing mat is not decreased by more than about 2% compared to the same roofing mat without the compound in the sizing, and more preferably not more than about 1%, and most preferably the tensile strength is not decreased. Tensile strength can be measured by any suitable method; one method is the measurement of MD Tensile, in which tensile strength is measured following ASTM D 5035-90 procedures. The MD Tensile can be measured on an Instron Tester (Model 1137) or other suitable apparatus. Preferably, the uniformity of fiber dispersion within the roofing mat is not significantly different compared to the same roofing mat without the compound in the sizing. Dispersion is usually based on visual inspection in a side by side comparison of sample mats.

In a second embodiment of the invention, the tear strength improvement is achieved by a modification of the coating material in combination with a modification of the sizing. Sulfur is added to the organic material of the coating material. The sulfur can be added in any suitable form, for example elemental sulfur. Tear strength can be improved by the addition of only a small amount of sulfur. Typically, the amount of elemental sulfur added to the organic material is from about 0.1% to about 5% by weight of the organic material, preferably from about 0.1% to about 2%, more preferably from about 0.1% to about 0.8%, and optimally about 0.2%.

The sizing includes a bonding material that bonds to the fiber material, and that bonds to the sulfur. The material can bond to the fiber material and to the sulfur in any suitable manner. For example, the material can be a compound having first functional groups that bond to the fiber material of the roofing mat. Alternatively, the material can bond to the fiber material by a grafting technique. The bonding of the material to the fiber material allows it to anchor to the fiber material. The material also bonds to the sulfur added to the organic material. For example, the material can be a compound having second functional groups that bond to the sulfur. This allows the sulfur to anchor to the material, which in turn is anchored to the fiber material. The sulfur reacts with residual double bonds in the organic material when the hot coating material is coated on the roofing mat. The added sulfur and the added bonding material thereby cooperate to enhance the interfacial bonding between the fiber material and the organic material and improve the tear strength of the roof covering.

Preferably, the second functional groups that bond to the sulfur include double bonds. Some nonlimiting examples of functional groups that can bind to the sulfur include vinyl groups, acrylic groups, sulfide groups and urethane groups. Any suitable compound having one or more of these groups can be used in a preferred embodiment. When the fibers are silica-based fibers (e.g., glass fibers), preferably the compound is a vinyl silane, for example Silquest® RC-1 organosilane ester from GE Silicones-OSi Specialties, Wilton, Conn., or Dynasylan Silfin® 06 vinylsilane from Degussa, Dusseldorf, Germany.

The bonding material can be added to the sizing in any amount suitable for achieving the improved tear strength. Preferably, the amount of the material added to the sizing is from about 1% to about 10% by weight of the solids in the sizing, more preferably from about 1% to about 5%, and optimally about 3.5%.

The principle and mode of operation of this invention have been described in its preferred embodiments. However, it should be noted that this invention may be practiced otherwise than as specifically illustrated and described without departing from its scope.

Experiments

In an initial experiment, Silquest RC-2 polysulfide silane was added to a sizing formulation, and roofing shingles were produced. Key performance properties of the roofing mat and shingle samples were compared to those of a control mat and shingle. The following results were obtained:

| Sample | Shingle CD Tear | Mat MD Tensile | Mat Dispersion | Notes |
|---|---|---|---|---|
| 1 | 1517 gm | 102 lb | 100% | Control |
| 2 | 1698 gm (+12%) | 101 lb (−1%) | 100% | 3.46% Silquest RC-2 (based on the total solids in the sizing) |

In a follow-up experiment, the amount of RC-2 polysulfide silane in the sizing formulation was tripled. The following results were obtained:

| Sample | Shingle CD Tear | Mat MD Tensile | Mat Dispersion | Notes |
|---|---|---|---|---|
| 3 | 1336 gm | 98 lb | 100% | Control |
| 4 | 1475 gm (+10%) | 99 lb (+1%) | 100% | 9.71% Silquest RC-2 |

The data suggest that the adsorption of RC-2 polysulfide silane onto the glass surface is probably limited to some extent. Once the sulfide silane reaches its maximum coverage on the glass surface, additional sulfide silane molecules simply will not be able to anchor on the glass surface for further interaction improvement. The data also show that the use of RC-2 polysulfide silane can improve shingle tear strength without sacrificing mat tensile and dispersion properties.

In another set of experiments, 3.46% RC-1 vinyl silane or Silfin 06 vinyl silane was added to a sizing formulation, and one-half the samples had 0.2 wt. % sulfur added to the asphalt. Roofing shingles were produced and measured for tear strength. The following results were obtained:

| Sample | Shingle CD Tear | Shingle Total Tear | Notes |
|---|---|---|---|
| 5 | 1467 gm | 2614 gm | RC-1 vinyl silane alone |
| 6 | 1703 gm (+16%) | 2906 gm (+11%) | RC-1 vinyl silane plus 0.2 wt. % sulfur in asphalt |

| Sample | Shingle CD Tear | Shingle Total Tear | Notes |
|---|---|---|---|
| 7 | 1498 gm | 2693 gm | Silfin 06 vinyl silane alone |
| 8 | 1789 gm (+19%) | 3002 gm (+11%) | Silfin 06 vinyl silane plus 0.2 wt. % sulfur in asphalt |

The data clearly show that a combination of a small amount of sulfur in the asphalt mix and a vinyl silane in the sizing formulation can significantly improve the tear strengths of roofing shingles.

What is claimed is:

1. A roof covering comprising:

a roofing mat formed from fibers of a fiber material, the fibers having properties suitable for forming the roofing mat, the fibers coated with a sizing; and an asphalt-based coating material that coats the mat;

the sizing including a film forming polymer, and a sulfur-containing material that bonds to the fiber material, the sulfur-containing material having therein sulfur groups that form cross-links with the asphalt;

wherein the roof covering is a roofing shingle and the tear strength of the roofing shingle is increased by at least about 5% as measured by ASTM D 1922 compared to the same roof covering without the sulfur-containing material in the sizing.

2. A roof covering according to claim 1 wherein the sulfur-containing material is a sulfide silane.

3. A roof covering according to claim 1 wherein the fiber material is glass.

4. The roof covering of claim 1, wherein the sizing additionally contains a coupling agent and a lubricant.

5. A roof covering according to claim 1 wherein the tensile strength of the roofing mat is not decreased by more than about 2% compared to the same roofing mat without the sulfur-containing material in the sizing, and wherein the uniformity of fiber dispersion within the roofing mat is not significantly different compared to the same roofing mat without the sulfur-containing material in the sizing.

6. A roof covering according to claim 1 wherein the amount of the sulfur-containing material in the sizing is from about 1% to about 10% by weight of the solids in the sizing.

7. A roof covering according to claim 1 further comprising roofing granules embedded in a surface of the coating material.

8. A roof covering according to claim 1 which has a tear strength of at least 1475 grams as measured by ASTM D 1922.

9. A roof covering comprising:

a roofing mat formed from fibers of a fiber material, the fibers being coated with a sizing; and a coating material that coats the mat, the coating material consisting essentially of asphalt, filler, and elemental sulfur, the elemental sulfur being added to the coating material in an amount from about 0.1% to about 2.0% by weight of the coating material, the sizing including a film forming polymer, a coupling agent, a lubricant, and a bonding material that bonds both to the fiber material and to the elemental sulfur;

wherein the elemental sulfur forms cross-links with the asphalt; and wherein the roof covering is a roofing shingle and the tear strength of the roofing shingle is increased by at least about 5% as measured by ASTM D 1922 compared to the same roof covering without the bonding material in the sizing and the sulfur added to the coating material.

10. A roof covering according to claim 9 wherein the bonding material is a compound having a first functional group that bonds to the fiber material and a second functional group that bonds to the sulfur.

11. A roof covering according to claim 10 wherein the second functional group of the compound includes a double bond.

12. A roof covering according to claim 11 wherein the second functional group is a vinyl group.

13. A roof covering according to claim 12 wherein the compound is a vinyl silane.

14. A roof covering according to claim 9 wherein the bonding material is a material that is bonded to the fiber material by grafting.

15. A roof covering according to claim 9 wherein the fiber material is glass.

16. A roof covering according to claim 9 wherein the tensile strength of the roofing mat is not decreased by more than about 2% compared to the same roofing mat without the bonding material in the sizing and the sulfur added to the coating material, and wherein the uniformity of fiber dispersion within the roofing mat is not significantly different compared to the same roofing mat without the bonding material in the sizing and the sulfur added to the coating material.

17. A roof covering according to claim 9 wherein the amount of the bonding material in the sizing is from about 1% to about 10% by weight of the solids in the sizing.

18. A roof covering according to claim 9 further comprising roofing granules embedded in a surface of the coating material.

19. A roof covering according to claim 9 which has a tear strength of at least 1475 grams as measured by ASTM D 1922.

20. A roof covering according to claim 9 wherein the sulfur reacts with double bonds in the asphalt.

21. A roof covering according to claim 9 wherein the elemental sulfur is added in an amount from about 0.1% to about 0.8% by weight of the coating material.

22. A roof covering according to claim 9 wherein the tear strength of the roof covering is increased by at least about 10% as measured by ASTM D 1922 compared to the same roof covering without the bonding material in the sizing and the sulfur added to the coating material.

23. A roof covering according to claim 9 wherein the tear strength of the roof covering is increased by at least about 15%.

24. The roof covering of claim 9, wherein the sizing additionally contains a coupling agent and a lubricant.

25. The roof covering of claim 10, wherein the first functional group is a silane group and the second functional group is a vinyl group, an acrylic group, a sulfide group or a urethane group.

26. A roof covering comprising:

a roofing mat formed from fibers selected from silica-based fibers, metal fibers, and combinations thereof coated with a sizing; and an asphalt-based coating material that coats the mat;

wherein the sizing includes a film forming polymer and a sulfur-containing material that has functional groups that bond to the fiber material, the sulfur-containing material having therein sulfur groups that form cross-links with the asphalt; and wherein the roof covering is a roofing shingle and the tear strength of the roofing shingle is increased by at least about 5% as measured by ASTM D 1922 compared to the same roof covering without the sulfur-containing material in the sizing.

27. The roof covering of claim 26, wherein the sulfur-containing material is a sulfide silane.

28. The roof covering of claim 26, wherein the tensile strength of the roofing mat is not decreased by more than about 2% compared to the same roofing mat without the sulfur-containing material in the sizing, and wherein the uniformity of fiber dispersion within the roofing mat is not significantly different compared to the same roofing mat without the sulfur-containing material in the sizing.

29. The roof covering of claim 26, wherein the amount of the sulfur-containing material in the sizing is from about 1% to about 10% by weight of the solids in the sizing.

30. The roof covering of claim 26, wherein the sizing additionally contains a coupling agent and a lubricant.

31. A roof covering comprising:

a roofing mat formed from fibers of a fiber material, the fibers being coated with a sizing; and a coating material that coats the mat, the coating material consisting essentially of asphalt, filler, and elemental sulfur, the elemental sulfur being added to the coating material in an amount from about 0.1% to about 2.0% by weight of the coating material, wherein the sizing includes a film forming polymer and a bonding material that bonds both to the fiber material and to the elemental sulfur;

wherein the elemental sulfur forms cross-links with the asphalt; and wherein said elemental sulfur and said bonding material cooperate to enhance interfacial bonding between said fiber material and said coating material.

32. The roof covering of claim 31, wherein the bonding material is a compound having first functional groups that bond to the fiber material and second functional groups that bond to the sulfur.

33. The roof covering of claim 32, wherein the second functional groups of the compound include double bonds.

34. The roof covering of claim 33, wherein the second functional groups are vinyl groups.

35. The roof covering of claim 31, wherein the sizing additionally contains a coupling agent and a lubricant.

36. The roof covering of claim 32, wherein the first functional group is a silane group and the second functional group is a vinyl group, an acrylic group, a sulfide group or a urethane group.

* * * * *